United States Patent [19]

Radford et al.

[11] Patent Number: 4,580,635

[45] Date of Patent: Apr. 8, 1986

[54] AUTOMATIC DRILL PIPE INSIDE WIPER

[75] Inventors: Steven R. Radford, West Jordan; Craig R. Hyland, Magna, both of Utah

[73] Assignee: Norton Christensen, Inc., Salt Lake City, Utah

[21] Appl. No.: 544,265

[22] Filed: Oct. 21, 1983

[51] Int. Cl.[4] ..... E21B 37/00

[52] U.S. Cl. ..... 166/311; 166/170; 166/177; 166/317; 15/104.05

[58] Field of Search ..... 166/170, 311, 174, 176, 166/153, 155, 195, 187, 177, 317; 92/87; 417/555 A; 15/104.05, 104.17, 104.18, 104.19; 34/22.11, 22.12

[56] References Cited

U.S. PATENT DOCUMENTS

| | | | |
|---|---|---|---|
| 2,264,822 | 12/1941 | Ahern | 15/104.05 |
| 2,460,481 | 2/1949 | Abel | 15/104.05 |
| 2,740,480 | 4/1956 | Cox | 166/170 |
| 2,769,498 | 11/1956 | Huber | 166/187 |
| 2,802,535 | 8/1957 | Taylor | 166/170 |
| 4,021,265 | 5/1977 | Guenther | 134/22 C |
| 4,287,948 | 9/1981 | Haggard | 166/170 |

FOREIGN PATENT DOCUMENTS

| | | | |
|---|---|---|---|
| 935142 | 6/1982 | U.S.S.R. | 15/104.05 |

*Primary Examiner*—James A. Leppink
*Assistant Examiner*—Hoang C. Dang
*Attorney, Agent, or Firm*—Beehler, Pavitt, Siegemund, Jagger & Martella

[57] ABSTRACT

A direct acting slug and wipe tool for use in drill pipe in drilling operations effects a cleaning operation by placing a rib inflated bladder in contact with the inside surface of a drill pipe in connection with a free floating pneumatic chamber. The inflatable bladder is toroidal and circumferentially disposed about and communicates with a sealed and closed chamber filled with a fixed amount or mass of gas. Weights may be added to the wiper in order to fix its equilibrium floating position. The wiper with the inflatable bladder is able to wipe the interior of the drill pipe even through those portions having a reduced inner diameter, such as at the drill pipe joints. Thus, as the drill pipe is tripped, the slug and wipe tool is longitudinally displaced with respect to the drill pipe through a plurality of drill pipe sections. In a second embodiment, a plurality or pair of intercommunicating ribbed inflatable bladders are circumferentially attached to the sealed and closed chamber thereby allowing one bladder to expand in a portion of the drill pipe having a normal sized diameter as the other bladder is simultaneously compressed when passing through a restricted diameter.

10 Claims, 3 Drawing Figures

AUTOMATIC DRILL PIPE INSIDE WIPER

BACKGROUND OF THE INVENTION

1. Field of the Invention

The field of the invention relates to oil well drilling tools and in particular to an apparatus and method from cleaning scale and other materials from the interior walls of a pipe or similar structure.

2. Description of the Prior Art

There has long been a recognized need to wipe the internal walls of cylindrical members used in drilling operations, such as drill pipe, tubing and casing. Mud, oil and scale, if thus not cleaned from the interior surface of such cylindrical members, spills onto the platform floor when the pipe is tripped from the bore. The spillage of such liquids is both hazardous and commercially uneconomical. The hazard is particularly accentuated in situations where the drilling operation occurs in freezing temperatures such as in the arctic. Fluid and dripping mud will freeze on the platform surface and in between the drill pipe in a pipe stand. Even in temperate environments, the spillage of fluids from the interior of the drill pipe creates personel hazards and impediments to secure operation. Thirdly, the hydraulic fluid or drilling mud used in many present day applications includes additives which are regarded as pollutants or potentially environmentally hazardous if spilled in oceans, bays and at other drilling sites. According to current drilling practices, a rust treatment is often applied to the interior of the pipe when it is tripped. In order for such a treatment to be effective mud, oil and ooze must first be scraped from the interior to allow direct access of the rust preventative to the pipe interior.

One design for a prior art drill casing wiper is shown by Haggard, "Tubular Interior Wiper", U.S. Pat. No. 4,221,264 wherein a pair of flexible wipers 36 and 42 are employed to provide a scraping action.

Another wiper, employing a multiplicity of flexible disk elements 11 for wiping the pipe interior is shown by Cox, "Pipe Wiper", U.S. Pat. No. 2,740,480.

Hauk, "Apparatus and Method for Removing Scale and Wax from Oil Well Tubing", U.S. Pat. No. 3,285,778 shows a rigid mechanical scraper which is used in conjunction with compressed air to remove hard adhering materials from the interior of a drill pipe as it is removed from a bore hole.

Greenfield, "Pipe Cleaner", U.S. Pat. No. 3,101,499 shows a hammering mechanism which is lowered into well casing, which remains in place, in an attempt to hammer hardened scale and debris from the interior surfaces of perforated sections of the casing.

Finally Mcspaddan, "Method and Apparatus for Cleaning Wells", U.S. Pat. No. 2,876,842 shows a prior art method where a plug of petroleum ceresin wax is used to remove scaled deposits from drill pipe as opposed to a mechanical scraping or hammering element.

Each of the prior art attempts to provide a cleaning mechanism to the interior of pipe in drilling operations suffers from the defect that uniform and efficient cleaning or scraping action is dependent upon a substantially uniform interior diameter of the pipe. As a practical matter, this is not the case. Cylindrical members, where they interconnect, for example, will have a reduced diameter. In those situations where prior art mechanisms are incapable of compressing through reduced diameter sections, such as in the mechanism shown by Hauk, the scraper can be used to clean only one section of pipe at a time. In other cases where the scraping element is capable of resiliently compressing to thereby allow the tool to pass through a restricted section, the increase in softness of the scraping element thus required inherently detracts from the rigidity of the scraping element in that portion of the drill pipe having a normal inner diameter. In other words, if the scraping element is soft enough to squeeze through a restricted joint section, it was often soft enough to also be deformed by a harder deposit of wax, scale or tar elsewhere on the pipe interior.

Therefore, what is needed is some type of drill pipe wiper which is capable of passing through multiple sections of drill pipe and yet capable of providing a uniform and strong scraping action throughout those portions of the drill pipe having a normal inner diameter.

BRIEF SUMMARY OF THE INVENTION

The present invention is a wiper for cleaning the interior surface of a tubular member as the tubular member is removed from a bore hole wherein the tubular member includes at least one portion with a restricted inner diameter. The wiper comprises a sealed pressurized chamber vessel which is injected with a predetermined fixed amount or mass of fluid, typically a compressible gas which is used for the purpose of pressurizing the chamber vessel. At least one resilient and inflatable bladder element is circumferentially disposed about the chamber vessel. The interior of the bladder element communicates with the interior of the pressurized chamber vessel. The bladder element is arranged and configured to contact the interior surface of the tubular member to thereby effect its cleaning. By virtue of this combination of elements, the inflatable bladder element is able to pass through restricted sections of the tubular member while maintaining an efficient cleaning action at all times even in the remaining unrestricted portions of the tubular member.

In the preferred embodiment of the invention, a plurality of bladder elements are incorporated wherein each bladder element communicates with the interior of the chamber vessel thereby providing intercommuncation among the plurality of bladder elements.

The invention also includes a method for cleaning the interior surfaces of a drill pipe which have an interior diameter characterized by restricted portions. The method comprises the steps of disposing a fixed amount or mass of compressible gas in a closed sealed chamber. The fixed amount of compressible gas is intercommunicated between the closed sealed chamber and at least one resilient inflatable bladder which is circumferentially disposed about the chamber. The bladder is inflated by the gas during this intercommunication by a degree sufficient to provide substantial contact between the bladder and the interior surface of the drill pipe. The drill pipe is then tripped thereby longitudinally displacing the drill pipe with respect to the inflated bladder. By this combination of steps, the drill pipe is cleaned as the inflated bladder is longitudinally displaced along the portions of the drill pipe having a normally sized inner diameter and the bladder is conpressed when it reaches or passes through the restricted portion of the drill pipe.

In the preferred embodiment, wherein a plurality of bladders are used, the method includes the steps of compressing one of the plurality of bladders by longitudinally displacing that one bladder to and through a portion of the drill pipe characterized by the restricted inner diameter. Meanwhile, the remaining ones of the plurality of bladders are simultaneously expanded by the gas which is displaced from the compressed bladder. Expansion of the remaining ones or one of the bladder elements occurs by virtue of the intercommunication of these elements through the sealed closed chamber. The longitudinal displacement of the bladders on the wiper tool is sufficient so that one bladder is being compressed by the restricted inner diameter while the other bladder is being expanded in those portions of the drill pipe having a normal sized inner diameter.

Turn now to the detailed description which follows wherein the invention and its various embodiments are better described in light of the above Figures.

DETAILED DESCRIPTION OF THE PREFERRED EMBODIMENTS

The drill pipe wiper of the invention is a direct acting slug and wipe tool. The tool is comprised of a cylindrical chamber having a rupturable seal at least at one end to allow for through pumping of hydraulic fluid. The cylindrical chamber, which is disposed inside the drill pipe, communicates with an exterior, toroidal, flexible, bladder wiper having a plurality of scraping ridges formed thereon. In a first embodiment one such bladder is provided and in a second embodiment two such bladder wipers are provided. In either case, the bladder pneumatically communicates with the cylindrical chamber and, in the case where two bladders are provided, pneumatically communicate with each other through the cylindrical chamber. As one bladder is squeezed through a restricted diameter within the pipe, gas or air is forced from the bladder into cylindrical chamber, and in the case of the two bladder embodiment into the adjacent bladder. Where two bladders are provided, one of the bladders will be passing through a narrowed constriction while the other bladder will be longitudinally displaced therefrom on the pipe wiper by a distance sufficient to place the adjacent bladder in a portion of the pipe having a normal diameter.

Figure 1:
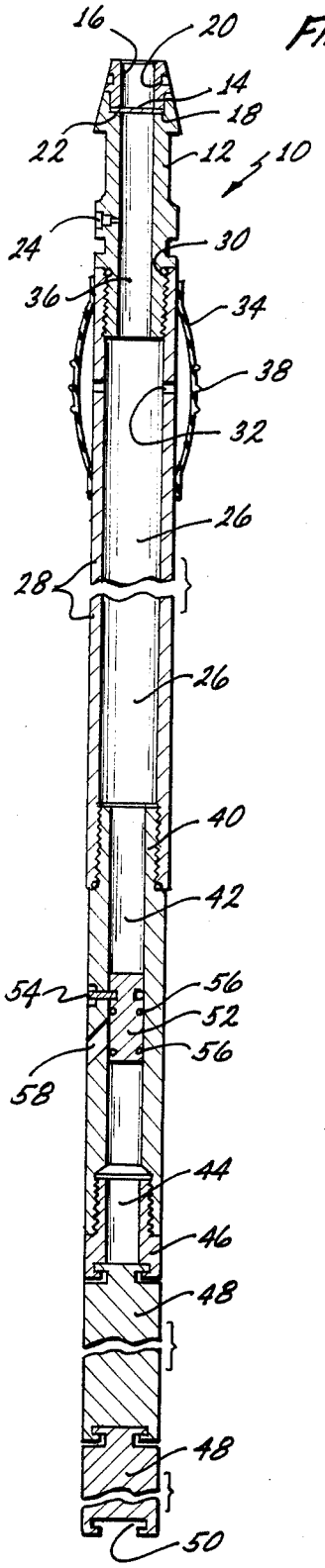
FIG. 1 is a longitudinal sectional view of a drill pipe wiper incorporating the invention.

Consider now the first embodiment as illustrated in FIG. 1. The wiper, generally denoted by reference numeral 10, includes a retrievable spear point 12 at its upper end. Spear point 12 is shaped and adapted for engagement with a wire line retrieval tool described in connection with FIG. 2 to permit easy handling and retrieval of the wiper from the platform. Spear point 12 also includes a rupture disk 14 disposed across the open end 16. Rupture disk 14 is secured within spear point 12 by mechanical capture within a shoulder 18 and by a threaded nose portion 20. A conventional O-ring 22 disposed between disk 14 and shoulder 18 hydraulically seals end 16 of spear point 12. Rupture disk 14 is designed to fail at a predetermined pressure differential according to means well known in the art.

Spear point 12 also includes a pneumatic pressurization port 24 disposed through the side of spear point 12. Pressurization port 24 provides a means for injecting a fixed amount or mass of gas, typically compressed air, into wiper 10 and more particularly into cylindrical chamber 26 defined by cylindrical member 28. The use of pressurization port 24 will be described in greater detail below when the operation of wiper 10 is illustrated.

Cylindrical member 28 is threadably coupled to spear point 12 in a conventional manner and hydraulically sealed thereto by means of O-ring 30. Cylindrical member 28 also includes a plurality of ports 32 defined therethrough which communicates cylindrical chamber 26 to the interior space defined by a flexible bladder 34. Flexible bladder 34 is a resilient toroidal inflatable element circumferentially disposed about the exterior of cylindrical member 28 and in pneumatic communication through ports 32 to cylindrical chamber 26. Cylindrical chamber 26 in turn pneumatically communicates to an axial chamber 36 defined within spear point 12 below ruptured disk 14.

Inflatable bladder 34 is also provided with a plurality of ridges, ribs or other protrusions 38 defined on its exterior surface. In the preferred embodiment, integrally formed spiral or circular ribbing, generally lying in a plane perpendicular to the longitudinal axis of wiper 10, is contemplated. However, it must be clearly understood that many other types of protrusions or elements to assist scraping could also be provided on the exterior of bladder 34. For example, longitudinal ribbing could be integrally formed; ribbing could be replaced by a multiplicity of studs or fingers; or additional jackets could be provided on the outside of a smooth bladder for the purposes of carrying metallic studs, scrapers and other equivalent elements now known or later discovered.

Cylindrical member 28 in turn is threadably coupled to valve sub 40. Valve sub 40 includes an axial chamber defined therethrough which communicates with a like axially defined chamber 44 defined within end plug 46. End plug 46 is also threadably coupled to the lower end of valve sub 40 and includes conventional means for attachment to a plurality of segmented sinker bars 48. Sinker bar 48 is a cylindrical solid member which is attachable to end plug 46 for the purposes of adding weight to wiper 10. Additional segmented sinker bars identical to bar 48 as depicted can be cascaded by attachment to lower end 50 of sinker bar 48 in substantially the same manner as bar 48 attaches to end plug 46. In the preferred embodiment, a lock twist flanged groove is provided t the lower end of end plug 46 and each sinker bar 50 into which groove a corresponding male member fits, which male member is provided at the top of each sinker bar.

Valve sub 40 also includes a bypass sliding valve piston 52 which is longitudinally and temporarily secured to valve sub 50 by means of a radially disposed shear pin 54. Shear pin 54 is disposed through valve sub 40 and into a mating indentation provided in bypass sliding valve piston 52. Piston 52 in turn hydraulically seals chamber 42 of valve sub 40 in a conventional manner by means of O-rings 56. O-rings 56 also serve to seal off bypass port 58. According to principles well known in the art, shear pin 54 is designed to shear at a predetermined force. Therefore, when the pressure within chamber 42 reaches a predetermined magnitude, the force on the upper surface of piston 52 will be sufficient to shear pin 54, thereby causing piston 52 to be longitudinally displaced within valve sub 40 toward end plug 46. Piston 52 in fact is displaceable by sufficient distance to uncover bypass port 58 thereby allowing hydraulic fluid to be pumped through wiper 10 and out port 58 into the drill pipe in a manner better described below.

Figure 2:
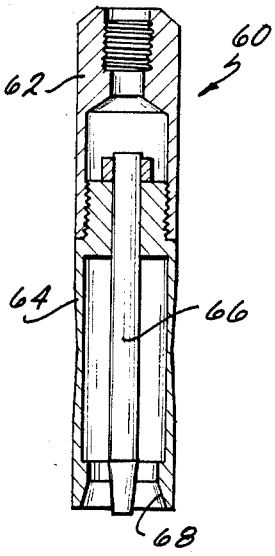
FIG. 2 is a longitudinal sectional view of a wireline retrieval tool used with the wiper.

Turn now to FIG. 2 wherein a specialized wire line retrieval tool, generally denoted by reference numeral 60, is depicted. Tool 60 includes an upper member 62 threadably connected to lower member 64. Lower member 64 includes a conventional end termination 68 adapted for resilient coupling to spear point 12. Included within lower member 64 is a axially disposed rod 66 lying along the longitudinal axis of tool 60. As described in greater detail below, when tool 60 engages spear point 12 of wiper 10 as shown in FIG. 1, longitudinal rod 66 will extend downwardly into spear point 12 thereby rupturing disk 14. Where used, this will allow the rapid removal of wiper 10, even in those cases where hydraulic pressures exceeding the burst pressure of disk 14 are not achieved. Longitudinal rod 66 is bolted in a conventional manner to lower member 64 and thus can be easily removed therefrom in the case where, as in normal opertion, rupture of disk 14 is not desired nor rapid removal of wiper 10 necessitated. Therefore, a wire line retrieval tool substantially as shown in FIG. 2 with longitudinal rod 66 deleted may also be used during normal operation of wiper 10 as described in greater detail below.

Figure 3:
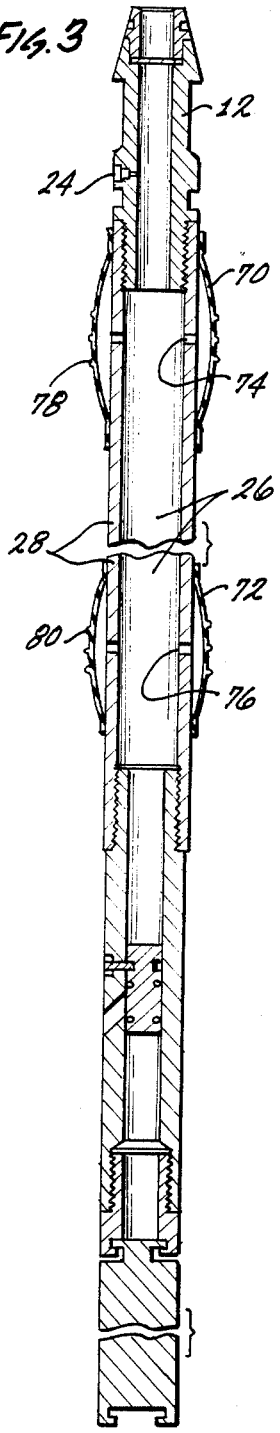
FIG. 3 is a longitudinal sectional view of a second embodiment of a drill pipe wiper incorporating the invention.

Before considering the second embodiment of the invention as depicted in FIG. 3, consider now the operation of wiper 10 as described in relation to FIG. 1. Wiper 10 is suspended above the drilling platform and drill pipe by a conventional means while a selected number of sinker bars 48 are attached in a cascaded manner to end plug 46. The number of sinker bars desired will depend upon the application at hand as determined by the pressure injected into wiper 10 through pressurization port 24, the density of the mud, the operation to be performed, the equilibrium depth below the well platform at which wiper 10 is desired.

Wiper 10 is then lowered into the drill pipe while still being suspended. Before wiper 10 is fully inserted, a selected amount of gas or air pressure is injected into cylindrical chamber 26 through port 24. Typically, 30 to 70 psi (gauge) will be provided depending upon the application.

Wiper 10 is thereafter released and allowed to free fall into the hydraulic fluid within the drill pipe in order to reach its equilibrium depth. Typically, wiper 10 will stabilize in a position 30 to 50 feet below the platform level. At this point, if desired, rust preventative may be poured into the drill pipe above wiper 10, which has scraped the interior pipe surface clean during this free fall descent. Bladder 34 will have been inflated and expanded to a sufficient degree to provide close and resilient contact with the drill pipe to provide an efficient scraping and cleaning action assisted by ridges 38. When wiper 10 reaches a constricted diameter of the drill pipe, the inherent resiliency of bladder 34 and its pneumatic inflation will cause the bladder to be compressed by forcing gas or air from the interior of bladder 34 into cylindrical chamber 26. After passing through the restriction, bladder 34 then reinflates to its initial scraping shape and size. If for any reason it is decided that wiper 10 should be removed, a wire line retrieval tool as shown in FIG. 2 is lowered and engages spear point 12. Axial spear 66 ruptures disk 14 thereby allowing for the depressurization of the bladder and rapid removal of the tool.

In the event it is necessary to quickly repressurize the hydraulic fluid within the drill casing, such as in a kicking operation where a subterranean pressure or gas begins to cause a well blow-out, hydraulic pressure can be quickly increased thereby forcing wiper 10 downwardly within the drill string toward the drill collars. The increased hydraulic pressure will cause disk 14 to rupture and ultimately will shear pin 54. Thereafter, the increase of hydraulic pressure to the limits of operation capability may be continued to prevent well blow out.

During normal operation, wiper 10 remains at its equilibrium point as the drill pipe is tripped. Ultimately, wiper 10 will be positioned just above the drill collars as the last segments of the drill string are retrieved from the bore hole. When the last joint of drill pipe is hanging in the slips, retrieval tool 60 is lowered and attached to wiper 10 which is then tripped. Wiper 10 is brought to the platform surface, depressurized, and then stored for next usage. If necessary, rupture disk 14 and piston 52 may be repositioned and fitted and any defective O-rings replaced. Wiper 10 is then ready for immediate reuse.

Turn now to the second embodiment of the invention as illustrated in longitudinal, sectional view in FIG. 3. The identical elements used in the embodiment of FIG. 3 are denoted by the same numerals of the like elements as shown in FIG. 1. The second embodiment of FIG. 3 differs from that of FIG. 1 in that the second embodiment includes a pair of inflatable bladders 70 and 72. As before, each bladder 70 and 72 pneumatically communicates through a corresponding plurality of ports 74 and 76 respectively with cylindrical chamber 26. The length of cylindrical member 28 in the preferred embodiment is approximately eight feet (96 cm.) which allows bladders 70 and 72 to be attached and disposed on cylindrical member 28 at opposite ends thereof. Therefore, in the illustrated embodiment, bladders 70 and 72 will be approximately eight feet (96 cm) apart. This distance is sufficient so that when one bladder is being compressed by the restricted diameter of a drill pipe joint, the other bladder remains in a section of the pipe having a normal diameter. Gas or air thus injected into cylindrical chamber 26 is therefore free to communicate between bladders 70 and 72. When one of these bladders is being compressed, some of the air forced therefrom will flow into the opposing bladder thereby increasing the ease with which wiper 10 may pass through restricted sections. In addition, the use of two bladders 70 and 72, carrying ribbed scraping elements 78 and 80 respectively, will provide for a redundant cleaning action as compared to the first embodiment of FIG. 1. Otherwise, the remaining elements of the second embodiment and their operation is substantially identical to that as shown and described in connection with the first embodiment of FIG. 1.

It must be expressly understood that many modifications and alterations may be made by those having ordinary skill in the art without departing from the spirit and scope of the invention. For example, although the inflatable bladders 34, 70 and 72 have been shown generally toroidal rubber elements, it is entirely within the scope of the invention that these elements could include more complex structures, such as a multiplicity of inflatable intercommunicating toroidal elements shaped like a segmented catepillar body. In addition, although in the illustrated embodiment cylindrical chamber 26 is filled with a compressible gas, it is also possible that a non-compressible fluid may be substituted for part of the total volume in the second embodiment of FIG. 3, if desirable. However, in the preferred embodiment the compressibility of the gas is by far the biggest consideration when one of the bladders is collapsed within a restriction.

Therefore, it must be understood that the illustrated embodiment has been shown only for the purposes of example and clarification, and should not be taken as limiting the scope of the invention as defined by the following claims.

We claim:

1. A wiper for cleaning the interior surface of a tubular member as said tubular member is removed from a bore hole wherein said tubular member includes at least one portion of restricted inner diameter, said wiper comprising:

a sealed, pressurized chamber vessel injected with a predetermined fixed amount of fluid for the purposes of pressurizing said chamber vessel;

at least one resilient and inflatable bladder element disposed about said chamber vessel, the interior of said bladder element communicating with said pressurized chamber vessel, said bladder element arranged and configured for contact with said interior surface of said tubular member to effect said cleaning thereof; and means for forcing hydraulic fluid through said wiper comprising a rupture disc disposed at one end of said wiper arranged configured to rupture at a predetermined magnitude of pressure differential thereacross, and a selectively actuatable valve disposed at said opposing end of said wiper, said wiper including an axial bore defined therethrough sealed at one end by said rupture disc and at said opposing end by said valve, hydraulic fluid being flowable through said wiper when said rupture disc has been ruptured and said valve selectively actuated, whereby said inflatable bladder element is able to pass through restricted sections of said tubular member while maintaining efficient cleaning action in remaining unrestricted portions of said tubular member.

2. The wiper of claim 1 wherein said selectively actuated valve comprises a bypass sliding valve piston longitudinally disposed in said axial bore of said wiper, a shear pin radially disposed through said wiper and engaging said sliding valve piston, and a bypass port defined through said chamber vessel and selectively covered by said sliding valve piston and hydraulically sealed from said axial bore by said sliding valve piston when said shear pin retains said piston in an initial position, said shear pin failing at a predetermined pressure on said piston and said piston sliding within said chamber of said wiper thereby opening said bypass port.

3. A slug and wiper tool for use in drill pipe joined together in a plurality of sections characterized by portions of a reduced internal diameter and a normal diameter, said tool comprising:

a cylindrical member having an axial bore defined there through;

a retrieval spear point connected to said cylindrical member and having an aligned axial bore defined there through, said axial bore of said spear point communicating freely with said axial bore of said cylindrical member;

a rupturable disc disposed across and sealing said axial bore of said spear point;

a pressurization port disposed through said spear point to allow for selective pressurization of said axial bore of said spear point by injection of a compressible gas;

a valve sub connected to said cylindrical member at an end of said cylindrical member opposing said end connected to said spear point, said valve sub having an axial bore defined there through aligned with said axial bore of said cylindrical member and freely communicating therewith;

selectively activatable valve means disposed within said valve sub for communicating said axial bore of said valve sub with the environment exterior to said valve sub;

at least one inflatable bladder member circumferentially disposed about said cylindrical member and characterized by a resiliency and capacity for compression sufficient to pass through said restricted portions of said drill pipe and for expansion sufficient to provide substantial contact between said bladder element and said interior surface of said drill pipe having a normal diameter; and a plurality of radial ports defined in said cylindrical member intercommunicating the interior of said bladder member with said axial bore of said cylindrical member;

whereby said compressible gas injected through said pressurization port into said axial bore of said spear point freely flows into said axial bore of said cylindrical member and into the interior of said bladder member and therebetween to provide for said expansion and compression of said bladder member within said drill pipe.

4. The slug and wiper tool of claim 3 further comprising a plurality of bladder elements, each circumferentially disposed about and attached to said cylindrical member and a corresponding plurality of radial ports defined through said cylindrical member, said radial ports communicating each of said plurality of bladder elements with said axial bore of said cylindrical member.

5. The slug and wiper tool of claim 4 further comprising an end plug connected to said valve sub on an end opposing said cylindrical member, and a plurality of segmated sinker bars, each arranged and configured for cascaded attachment one to each other and to said end plug.

6. The slug and wiper tool of claim 3 wherein said valve means is arranged and configured to automatically and selectively activate thereby communicating said axial bore of said valve sub with said exterior environment at a predetermined pressure within said axial bore of said valve sub.

7. The slug and wiper tool of claim 6 wherein said valve means comprises a bypass sliding valve piston longitudinally disposed in said axial bore of said valve sub and longitudinally displaceable therein, a shear pin radially disposed through said valve sub and engaging said sliding valve piston to retain said sliding valve piston in an initial position, a bypass port defined through said valve sub for communicating said exterior environment with said axial bore of said valve sub, said bypass port being sealed by said sliding valve piston when said sliding valve piston is in said initial position, said shear pin characterized by failure at said predetermined pressure thereby permitting said sliding valve piston to be longitudinally displaced within said valve sub and thereby opening said bypass port with said axial bore of said valve sub.

8. A method for cleaning the interior surfaces of a drill pipe having a variable interior diameter characterized by restricted portions, said method comprising the steps of:

disposing a fixed amount of compressible gas in a closed, sealed chamber;

intercommunicating said fixed amount of compressible gas between said closed sealed chamber and at least two resilient inflatable bladders circumferentially disposed about said chamber, said bladders being inflated by said gas to a sufficient degree to provide substantial contact between said bladders and said interior surface of said drill pipe; and longitudinally displacing said drill pipe with respect to said inflated bladders thereby cleaning said drill pipe as said inflated bladders are longitudinally displaced along those portions of said drill pipe having a normally sized inner diameter and compressing only one of said bladders when said restricted portion of said drill pipe is longitudinally displaced across said bladder, wherein said step of intercommunicating said compressible gas between said sealed and closed chamber in said compressed one of said bladders includes intercommunicating said compressible gas between said sealed closed chamber and at least the other one of said bladders.

9. A method for cleaning the interior surfaces of a drill pipe having an interior diameter characterized by restricted portions, said method comprising the steps of: disposing a fixed amount of compressible gas in a closed, sealed chamber;

intercommunicating said fixed amount of compressible gas between said closed sealed chamber and a plurality of resilient inflatable bladders circumferentially disposed about said chamber, said bladders being inflated by said gas to a sufficient degree to provide substantial contact between said bladders and said interior surface of said drill pipe;

longitudinally displacing said drill pipe with respect to said inflated bladder thereby cleaning said drill pipe as said inflated bladder is longitudinally displaced along those portions of said drill pipe having a normally sized inner diameter and compressing said bladders when said restricted portion of said drill pipe is longitudinally displaced across said bladder, compressing one of said plurality of bladder elements by longitudinally displacing said one bladder within a portion of said drill pipe characterized by a restricted inner diameter; and simultaneously expanding said remaining ones of said bladders with said gas displaced from said compressed bladder through communication within said sealed closed chamber, said remaining ones of said bladders being longitudinally disposed in said drill pipe in a portion having a normal sized inner diameter.

10. A method for cleaning the interior surfaces of a drill pipe having an interior diameter characterized by restricted portions, said method comprising the steps of:

disposing a fixed amount of compressible gas in a closed, sealed chamber;

intercommunicating said fixed amount of compressible gas between said closed sealed chamber and a resilient inflatable bladder circumferentially disposed about said chamber, said bladder being inflated by said gas to a sufficient degree to provide substantial contact between said bladder and said interior surface of said drill pipe;

longitudinally displacing said drill pipe with respect to said inflated bladder thereby cleaning said drill pipe as said inflated bladder is longitudinally displaced along those portions of said drill pipe having a normally sized inner diameter;

compressing said bladder when said restricted portion of said drill pipe is longitudinally displaced across said bladder, and rupturing said sealed closed chamber by forcing hydraulic fluid therethrough at a pressure magnitude greater than a predetermined level, thereby forcing hydraulic fluid through said wiper into said drill pipe below said wiper in order to prevent blowout.

* * * * *